US010543954B2

(12) United States Patent
Couture

(10) Patent No.: US 10,543,954 B2
(45) Date of Patent: Jan. 28, 2020

(54) METHOD AND BLANKS FOR FORMING A SHELF-READY DISPLAY CONTAINER

(71) Applicant: WestRock Shared Services, LLC, Norcross, GA (US)

(72) Inventor: David G. Couture, Suwanee, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 716 days.

(21) Appl. No.: 15/079,534

(22) Filed: Mar. 24, 2016

(65) Prior Publication Data

US 2017/0275047 A1 Sep. 28, 2017

(51) Int. Cl.

| | |
|---|---|
| ***B65D 5/58*** | (2006.01) |
| ***B65D 5/54*** | (2006.01) |
| ***B65D 5/56*** | (2006.01) |
| ***B31B 50/26*** | (2017.01) |
| ***B65D 5/44*** | (2006.01) |
| *B31B 120/40* | (2017.01) |
| *B31B 105/00* | (2017.01) |

(52) U.S. Cl.

CPC ..... *B65D 5/5445* (2013.01); *B31B 50/26* (2017.08); *B65D 5/445* (2013.01); *B65D 5/566* (2013.01); *B31B 2105/00* (2017.08); *B31B 2120/40* (2017.08); *B31B 2120/407* (2017.08)

(58) Field of Classification Search

CPC ..... B65D 5/56; B65D 5/445; B65D 5/566; B65D 5/58; B31B 2121/40; B31B 2120/25; B31B 2120/407; B31B 2120/408

USPC ..... 206/774

See application file for complete search history.

(56) References Cited

U.S. PATENT DOCUMENTS

| | | | | |
|---|---|---|---|---|
| 2,382,891 | A | 8/1945 | Mccormick | |
| 3,883,065 | A * | 5/1975 | Presnick | B65D 5/36 206/521 |
| 4,000,811 | A | 1/1977 | Hardison et al. | |
| 4,184,625 | A * | 1/1980 | Stollberg | B65D 5/5035 206/521.1 |
| 5,018,663 | A | 5/1991 | Corso | |
| 5,487,504 | A | 1/1996 | Baird | |
| 5,957,294 | A | 9/1999 | Kanter | |
| 6,189,780 | B1 | 2/2001 | Kanter | |
| 6,371,365 | B1 | 4/2002 | Doucette et al. | |
| 6,488,201 | B1 | 12/2002 | Van Eijndhoven et al. | |
| 7,066,379 | B2 * | 6/2006 | McLeod | B65D 5/321 229/120.24 |

(Continued)

FOREIGN PATENT DOCUMENTS

| | | | |
|---|---|---|---|
| EP | 667295 | B1 | 7/1998 |
| WO | WO1999055590 | A2 | 11/1999 |

(Continued)

*Primary Examiner* — Anthony D Stashick
*Assistant Examiner* — Raven Collins
(74) *Attorney, Agent, or Firm* — WestRock IP Legal

(57) ABSTRACT

A container formed from a blank and a method for constructing the container are described. The container includes a shell and a liner disposed substantially within the shell. The shell includes a bottom wall, two opposing end walls including a first and well and a second end wall, and two opposing side walls including a first side wall and a second side wall. The shell further includes a plurality of top panels extending from a top edge of each of the first end wall, the second end wall, the first side wall, and the second side wall.

11 Claims, 7 Drawing Sheets

(56) References Cited

U.S. PATENT DOCUMENTS

| | | | | |
|---|---|---|---|---|
| 7,607,564 | B2 | 10/2009 | Churvis et al. | |
| 7,784,676 | B2 | 8/2010 | Borek et al. | |
| 8,430,297 | B2 | 4/2013 | Gatrost et al. | |
| 8,596,460 | B2 * | 12/2013 | Scatterday ..... | B65D 5/54 206/736 |
| 8,763,803 | B2 | 7/2014 | Swart et al. | |
| 8,998,074 | B2 | 4/2015 | Schomisch | |
| 9,061,791 | B2 | 6/2015 | Cameron | |
| 2013/0186804 | A1 | 7/2013 | Miller | |
| 2015/0251797 | A1 | 9/2015 | Carman | |
| 2015/0329235 | A1 | 11/2015 | Armiento et al. | |

FOREIGN PATENT DOCUMENTS

| | | | |
|---|---|---|---|
| WO | WO2014189778 | A1 | 11/2014 |
| WO | WO2015066144 | A1 | 5/2015 |

* cited by examiner

METHOD AND BLANKS FOR FORMING A SHELF-READY DISPLAY CONTAINER

BACKGROUND

This invention relates generally to a blank of sheet material and a reinforced container formed from the blank and, more particularly, to a reinforced, convertible shipping container having a removable top portion, a reinforcing insert coupled to the top portion, and a tray portion, wherein the container is convertible into a display tray when the top portion and the reinforcing insert are removed together from the tray portion.

Containers fabricated from paperboard and/or corrugated paperboard material are often used to store and transport goods. Such containers are usually formed from blanks of sheet material that are folded along a plurality of preformed fold lines to form an erected corrugated container. At least some known blanks include a pair of end panels, a pair of side panels, a glue tab, a bottom panel, and, in some cases, a top panel, connected by a plurality of fold lines. The panels are rotated to form end walls, side walls, a bottom wall, and a top wall of the container. To form at least some known containers, some of the panels are secured using an adhesive. Such known containers are formed using a machine and/or by hand. At least some known containers are further configured to separate a top portion of the container from a display (or tray) portion of the container.

At least some such containers have certain strength requirements for storing and transporting products. These strength requirements may include a stacking strength requirement such that the containers can be stacked on one another during transport without collapsing. To meet these strength requirements, at least some known containers include reinforcing liners for providing additional strength, including stacking strength. At least some such containers are additionally retail-ready packaging (RRP) containers that convert from a shipping container into a display container, where the interior contents of the container are showcased. These RRP types of containers oftentimes lack stacking strength because of perforations and other lines of weakness that are included in the container to allow them to be convertible. Unfortunately, these containers that include reinforcing inserts can be less than desirable for retail applications, for example, because the clerk who may convert the shipping container into a display container may remove the upper portion of the container without removing the reinforcing liner from within the container. By not removing the reinforcing liner from within the container, consumers may not have easy of access to the products in the container and/or may not be able to easily see the products housed in the container when being displayed, which detracts from the effectiveness and convenience of such containers.

BRIEF DESCRIPTION OF THE DISCLOSURE

In one aspect, a reinforced shipping container formed from a pair of blanks is provided. The container is convertible from a shipping configuration to a display configuration. The container includes an outer shell formed from a first blank, and the outer shell includes a plurality of side faces. The plurality of side faces includes a first and second set of opposing side walls. The plurality of side faces further includes a line of weakness extending across the side faces. The line of weakness defines a top portion and a tray portion of the outer shell. The line of weakness enables separation of the top portion from the tray portion of the outer shell. The container further includes a reinforcing liner formed from a second blank positioned within the outer shell. The liner includes a plurality of side panels including at least a first, a second, and a third side liner panel. The first and third side liner panels are positioned adjacent to and in a face-to-face relationship with one of the side walls of the outer shell. The second side liner panel is positioned adjacent to and in a face-to-face relationship with one of the side walls of one of the other sets of side walls of the outer shell. The reinforcing liner is coupled to the top portion of the outer shell such that, when the container is converted from the shipping configuration to the display configuration by separating the top portion from the tray portion along the line of weakness, the reinforcing liner is removed along with a top portion of the outer shell.

In another aspect, a method for forming a container from a pair of blanks is provided. The pair of blanks includes an outer shell blank and a reinforcing liner blank. The shell blank includes a plurality of side panels, a plurality of top panels extending from a top edge of each of the plurality of side panels, and a plurality of bottom panels extending from a bottom edge of each of the plurality of side panels. The plurality of side panels includes a line of weakness extending along the plurality of side panels, the line of weakness defining a top portion and a display portion of the container. The reinforcing liner blank includes a plurality of liner side panels including at least a first, a second, and a third liner side panel. The method includes rotating each of the plurality of side panels inwardly to form a first and second set of opposing side walls, and the first set of opposing side walls is positioned substantially perpendicular to the second set of opposing side walls. The method further includes rotating each of the plurality of bottom panels inwardly into a substantially perpendicular relationship with the plurality of side panels, and securing each of the plurality of bottom panels to form a bottom surface of the container. The method further includes rotating each of the plurality of bottom panels to form a bottom surface of the container. The method further includes inserting the liner into a cavity formed by the shell blank such that the first and third liner side panels are positioned adjacent to and in a face-to-face relationship with one of the side walls of one of the sets of side walls of the outer shell, and the second liner side panel is positioned adjacent to and in a face-to-face relationship with one of the side walls of one of the other sets of side walls of the outer shell. The method further includes rotating each of the plurality of top panels inwardly into a substantially perpendicular relationship with the plurality of side panels, and securing each of the plurality of top panels into a shipping configuration for the container.

In another aspect, a pair of blanks for constructing a container is provided. The pair of blanks includes an outer shell blank formed from a first blank and a reinforcing liner blank formed from a second blank. The shell blank includes a plurality of side panels including a first end panel, a first side panel extending from a side edge of the first end panel, a second end panel extending from a side edge of the first side panel, and a second side panel extending from a side edge of the second end panel. A line of weakness extends across the plurality of side panels, and the line of weakness defines a top portion and a display portion of the shell blank. The shell blank further includes a plurality of top panels extending from a top edge of each of the first end panel, the first side panel, the second end panel, and the second side panel. The shell blank further includes a plurality of bottom panels extending from a bottom edge of each of the first end panel, the first side panel, the second end panel, and the second side panel. The liner blank includes a plurality of side panels including at least a first, a second, and a third liner side panel. The second side liner panel extends from a side edge of the first side liner panel, and the third side liner panel extends from a side edge of the second side liner panel.

DETAILED DESCRIPTION OF THE DISCLOSURE

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The embodiments described herein provide a stackable, reinforced, convertible shipping container formed from a pair of blanks, and a method for constructing the same. The blanks are constructed from sheet material. The container may be constructed from sheet material using a machine and/or by hand. In one embodiment, the blank is fabricated from a corrugated cardboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

Figure 1:
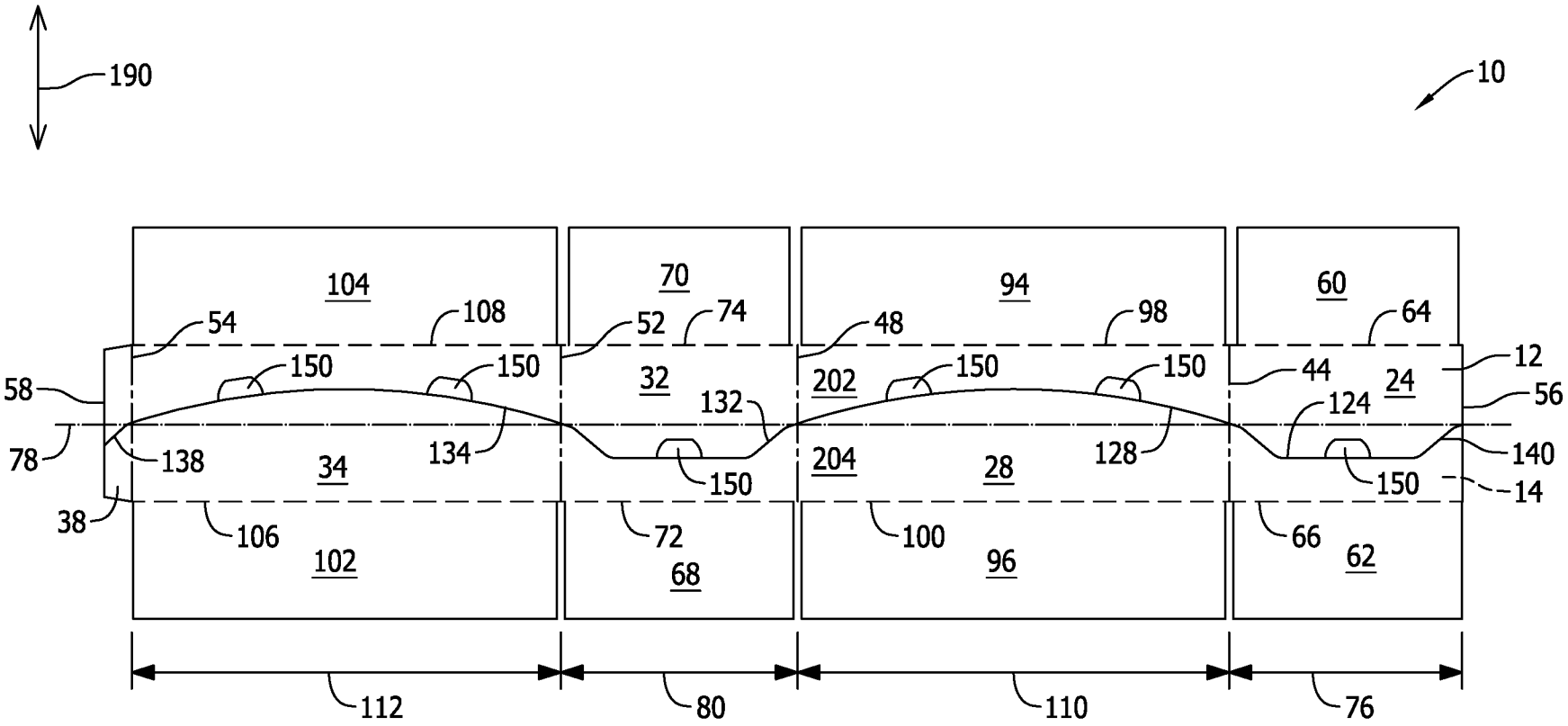
FIG. 1 is a top plan view of an example embodiment of a blank of sheet material for constructing a reinforced, convertible shipping container in accordance with the present disclosure.

FIG. 1 illustrates a top plan view of an example embodiment of a substantially flat blank 10 of sheet material. As shown in FIG. 1, blank 10 (or outer shell blank 10, or first blank 10) has an interior surface 12 and an exterior surface 14. In certain embodiments, portions of exterior surface 14 and/or interior surface 12 of blank 10 include printed graphics, such as advertising and/or promotional materials.

Blank 10 includes a series of aligned side panels and end panels connected together by a plurality of preformed, generally parallel, fold lines. Although referred to herein as side panels and end panels, the panels included in blank 10 that are used to form the side walls of the container may be collectively referred to as side panels or side faces.

Specifically the side panels include a first end panel 24, also referred to as a rear end panel 24, a first side panel 28, a second end panel 32, also referred to as a front end panel 32, a second side panel 34, and a glue tab 38 connected in series along a plurality of fold lines 44, 48, 52, and 54. First end panel 24 extends from a first free edge 56 to fold line 44, first side panel 28 extends from first end panel 24 along fold line 44, second end panel 32 extends from first side panel 28 along fold line 48, second side panel 34 extends from second end panel 32 along fold line 52, and glue tab 38 extends from second side panel 34 along fold line 54 to a second free edge 58. Panels 24, 28, 32, and 34 may be referred to as first and second sets of opposing side walls, where panels 24 and 32 are one set and panels 28 and 34 are another set.

A first top end panel 60 and a first bottom end panel 62 extend from opposing edges of first end panel 24. More specifically, first top end panel 60 and first bottom end panel 62 extend from a first end panel 24 along a pair of opposing preformed, generally parallel, fold lines 64 and 66 respectively. Similarly, a second bottom end panel 68 and a second top end panel 70 extend from opposing edges of second end panel 32. More specifically, second bottom end panel 68 and second top end panel 70 extend along a pair of opposing preformed, generally parallel, fold lines 72 and 74, respectively. Fold lines 64, 66, 72, and 74 are generally parallel to each other and generally perpendicular to fold lines 44, 48, and 52. First end panel 24 has a width 76 taken along a central horizontal axis 78 of blank 10 that is substantially equal to width 80, also taken along central horizontal axis 78 of blank 10.

As shown in FIG. 1, a first top side panel 94 and a first bottom side panel 96 extend from opposing edges of first side panel 28. More specifically, first top side panel 94 and first bottom side panel 96 extend from first side panel 28 along a pair of opposing preformed, generally parallel, fold lines 98 and 100, respectively. Similarly, a second bottom side panel 102 and a second top side panel 104 extend from opposing edges of second side panel 34. More specifically, second bottom side panel 102 and second top side panel 104 extend from second side panel 34 along a pair of opposing preformed, generally parallel, fold lines 106 and 108, respectively. Fold lines 98, 100, 106, and 108 are generally parallel to each other and generally perpendicular to fold lines 44, 48, 52, and 54. First side panel 28 has a width 110 taken along central horizontal axis 78 of blank 10 that is substantially equal to width 112 of second side panel 34, also taken along central horizontal axis 78.

First end panel 24 includes a line of weakness 124, first side panel 28 includes a line of weakness 128, second end panel 32 includes a line of weakness 132, second side panel 34 includes a line of weakness 134, and tab 38 includes a line of weakness 138. As used herein, the term "line of weakness" refers to any preformed line, such as but not limited to score lines, perforation lines, or lines of separation, along which the blank material is configured to have a relatively decreased resistance to folding or tearing. In the example embodiment, line of weakness 124 extends from a first edge of first end panel 24, defined by free end 56, to a second edge of first end panel 24, defined by fold line 44. Similarly, in the example embodiment, line of weakness 132 extends along second end panel 32 substantially identically to the shape of line of weakness 124 along first end panel 24, such that line of weakness 132 extends from a first edge of second end panel 32, defined by fold line 48, to a second edge of second end panel 32, defined by fold line 52.

In the example embodiment, line of weakness 128 extends arcuately from a first edge of first side panel 28, defined by fold line 44, to a second edge of first side panel 28, defined by fold line 48. Similarly, in the example embodiment, line of weakness 134 extends arcuately along second side panel 34 substantially identically to the shape of line of weakness 128 along first side panel 28, such that line of weakness 134 extends from a first edge of second side panel 34, defined by fold line 52, to a second edge of second side panel 34, defined by fold line 54. Further, in the example embodiment, line of weakness 138 extends along tab 38 from a first edge of tab 38, defined by fold line 54, to a second edge of tab 38, defined by free end 58. In alternative embodiments, one or more lines of weakness 124, 128, 132, 134 and/or 138 may extend linearly across respective panels 24, 28, 32, 34, and/or 38.

In the example embodiment, lines of weakness 124 and 128 are connected at fold line 44, lines of weakness 128 and 132 are connected at fold line 48, lines of weakness 132 and 134 are connected at fold line 52, and lines of weakness 134 and 138 are connected at fold line 54. Lines of weakness 124, 128, 132, 134, and 138 connect to form a continuous line of weakness 140.

In the example embodiment, first end panel 24, first side panel 28, second end panel 32, and second side panel 34 include a plurality of access regions 150 disposed adjacent to respective lines of weakness 124, 128, 132, and 134. In the example embodiment, access regions 150 are regions or areas of weakness that can be punched-out by a user, leaving a cavity or hole in one of side panels 24, 28, 32, 34. In alternative embodiments, blank 10 includes access regions 150 in any suitable number and configuration that enables blank 10 to function as described herein.

In the example embodiment, blank 10 is fabricated from a corrugated cardboard material and includes a plurality of corrugations or flutes (not shown) therein, oriented parallel to a corrugation direction indicated at 190. As described further herein, corrugation direction 190 facilities improved stacking strength for blank 10 when erected into a container, like the container shown in FIG. 4.

Figure 5:
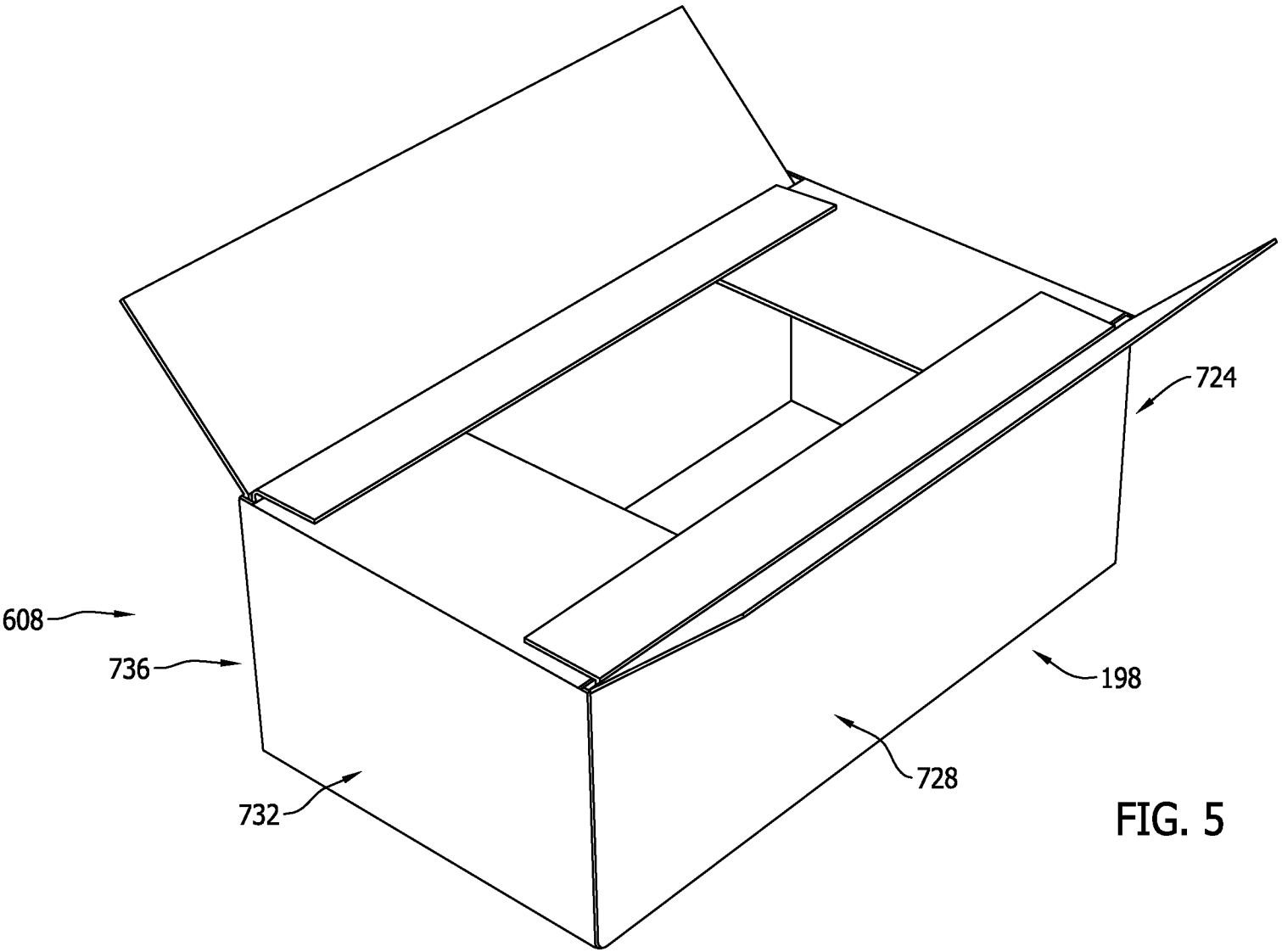
FIG. 5 illustrates a perspective view of the container shown in FIG. 4 erected into a partially closed configuration.
Figure 6:
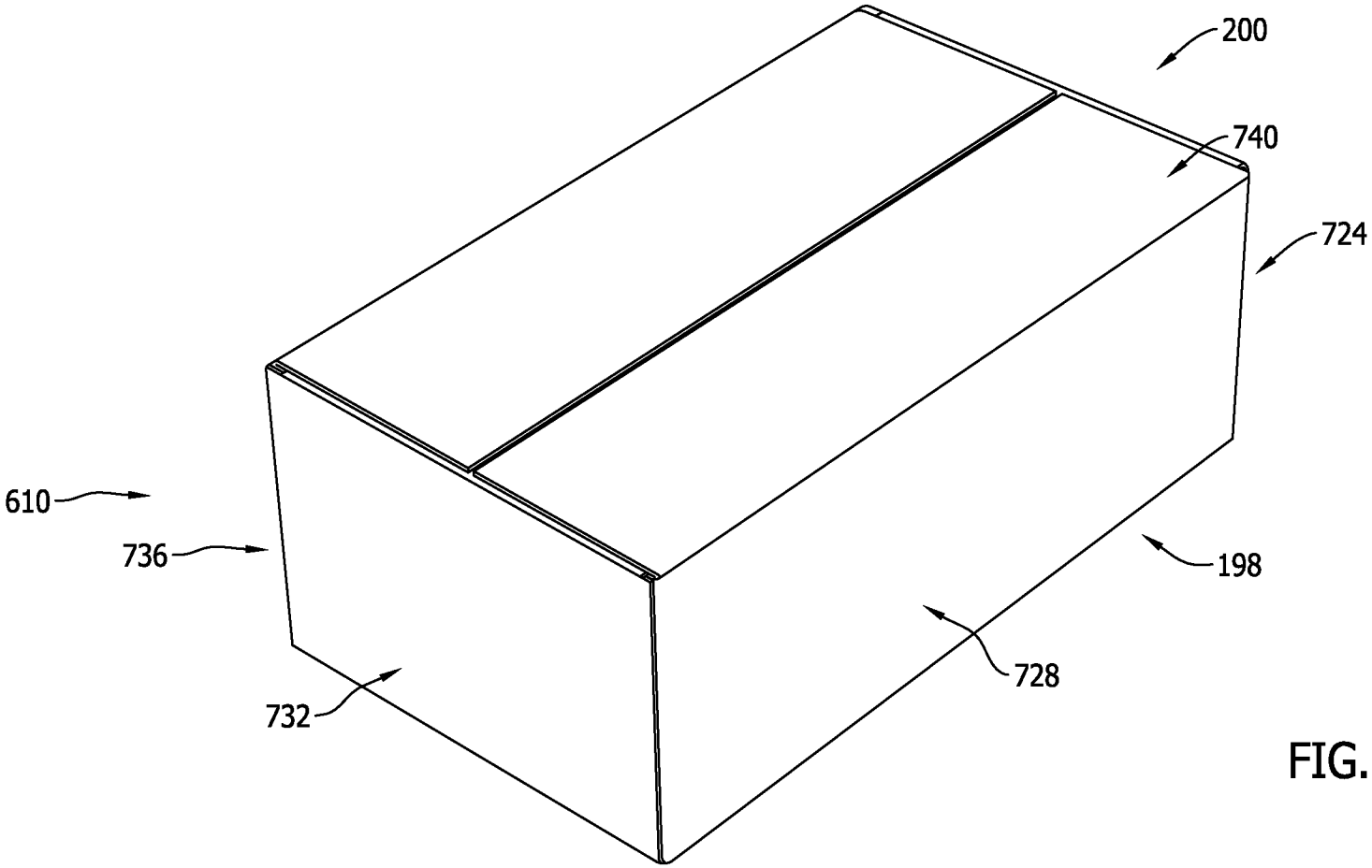
FIG. 6 illustrates a perspective view of the container shown in FIG. 4 in a completely closed, shipping configuration.
Figure 7:
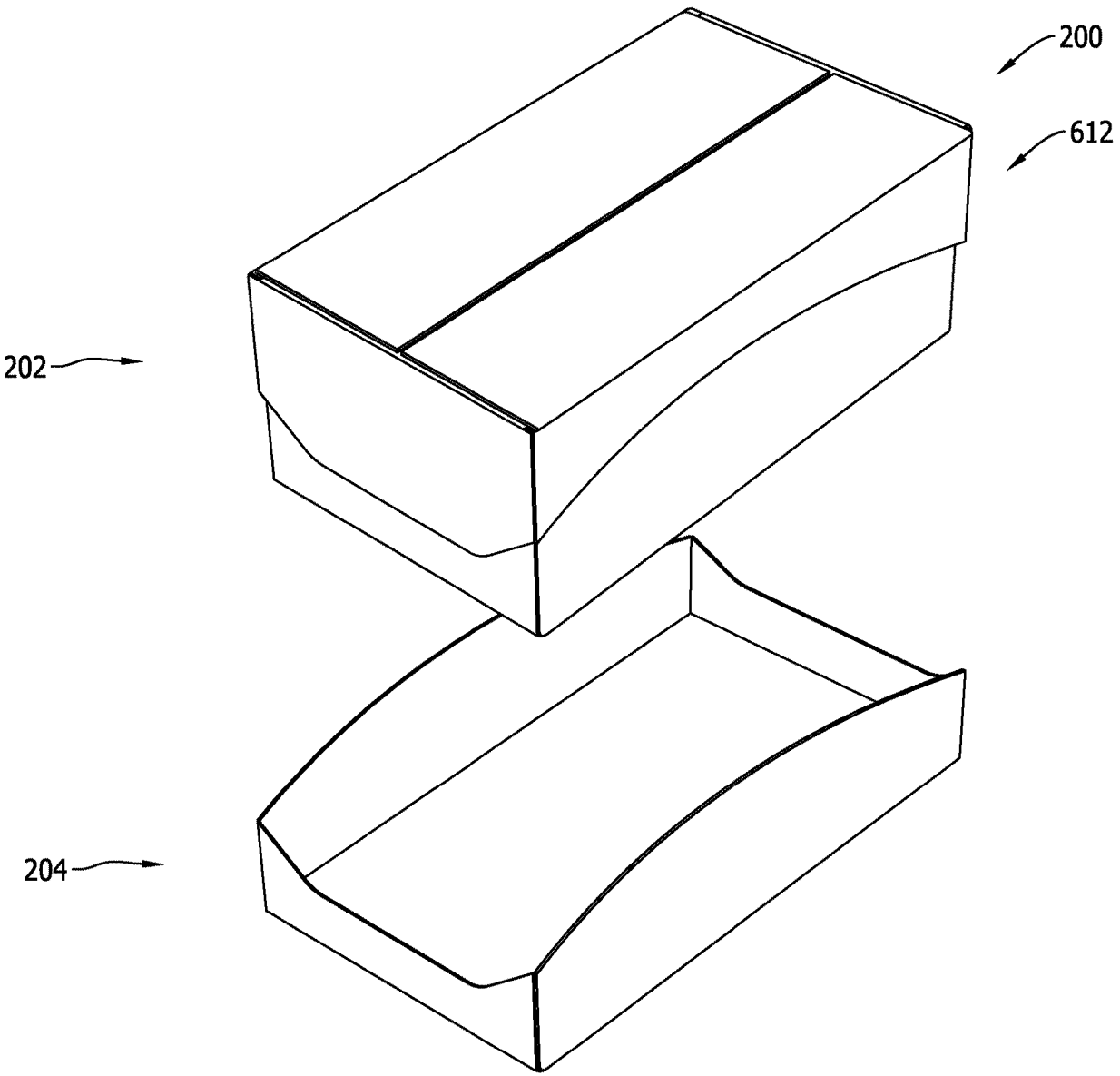
FIG. 7 illustrates a perspective view of the container shown in FIG. 4 with the top portion removed, converting the container into a display configuration.

As will be described below in more detail with reference to FIGS. 4-7, blank 10 is intended to form an outer shell 198 of container 200 as shown in FIGS. 4-7 by folding and/or securing panels 24, 28, 32, 34, and/or 38 (shown in FIG. 1) and bottom panels 62, 68, 96, and/or 102 (shown in FIG. 1). Once blank 10 is formed into shell 198, line of weakness 140 defines a top portion 202 and a display (or tray) portion 204 of shell 198 and container 200 as shown in FIG. 7. Of course, blanks having shapes, sizes and configurations different from blank 10 described and illustrated herein may be used to form shell 198 shown in FIGS. 4-7 without departing from the scope of the present invention. In other words, the processes described herein can be used to form a variety of different shaped and sized containers, and is not limited to blank 10 shown in FIG. 1 and/or shell 198 shown in FIGS. 4-7.

Figure 2:
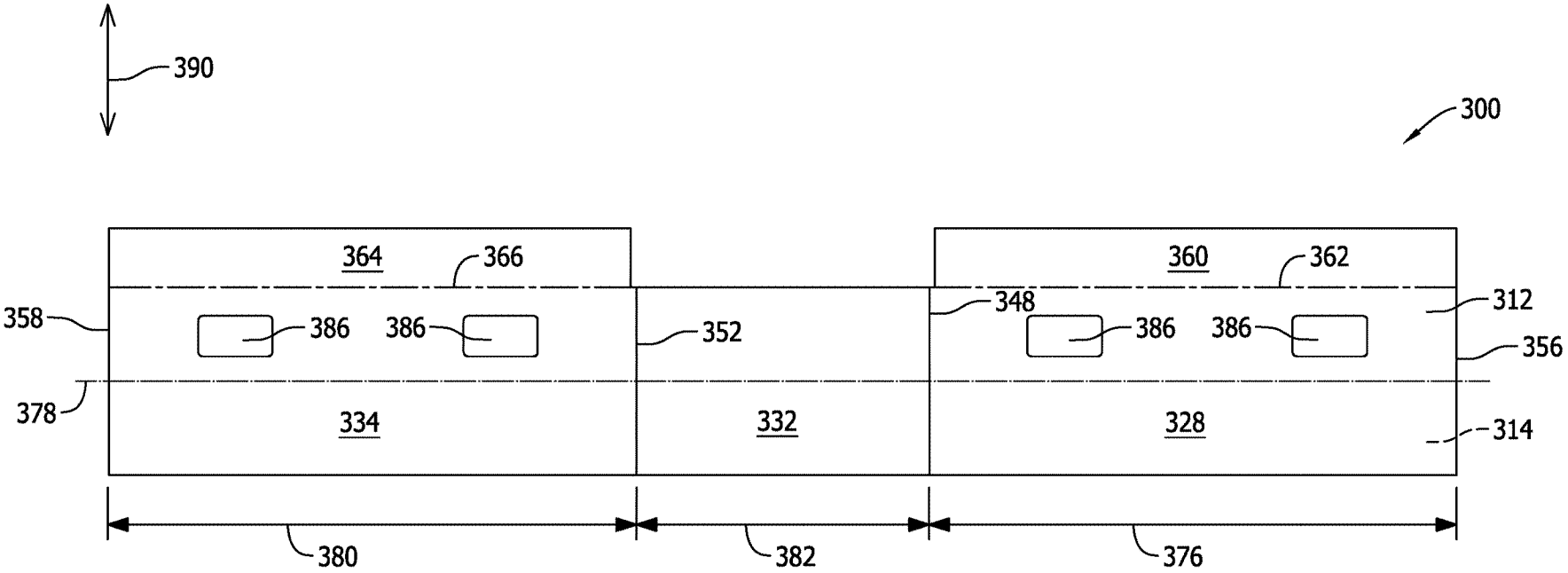
FIG. 2 is a top plan view of an example embodiment of a liner used with the blank shown in FIG. 1 to form the container shown in FIG. 4.

FIG. 2 illustrates a top plan view of an example embodiment of a reinforcing liner 300 used with blank 10 for constructing container 200. Liner 300 (or liner blank 300, or second blank 300) has an interior surface 312 and an exterior surface 314. Liner 300 includes a series of aligned wall panels and end panels connected together by a plurality of preformed, generally parallel, fold lines. Specifically, the walls panels include a first liner side panel 328 (or first side liner panel 328), a liner end panel 332 (or a first liner end panel 332, or second side liner panel 332), and a second liner side panel 334 (or third side liner panel 334) connected in series along a plurality of fold lines 348 and 352. First liner side panel 328 extends from a first free edge 356 to fold line 348, liner end panel 332 extends from first liner side panel 328 along fold line 348, and second liner side panel 334 extends from liner end panel 332 along fold line 352 to a second free edge 358. In alternative embodiments, a second liner end panel (not shown) is provided that extends from second liner side panel 334 at free edge 358 and is substantially congruent to first liner end panel 332. Although referred to as liner side panels and liner end panels, the panels included in liner 300 may be collectively referred to as liner side panels.

A first top liner panel 360 extends from the edge of first liner side panel 328 along a fold line 362. A second top liner panel 364 extends from the edge of second liner side panel 334 along a fold line 366. Fold lines 362 and 366 are generally parallel to each other and generally perpendicular to fold lines 348 and 352. First liner side panel 328 has a width 376 taken along a central horizontal axis 378 of liner 300 that is substantially equal to width 380 of second liner side panel 334, also taken along central horizontal axis 378 of liner 300. Widths 376 and 380 are slightly less than widths 110 and 112 of blank 10 to accommodate liner 300 inside shell 198 when blank 10 is constructed into shell 198. Liner end panel 332 has a width 382 taken along central horizontal axis 378. Width 382 is slightly less than width 80 or width 76 of blank 10 to accommodate liner 300 inside shell 198.

In the example embodiment, liner 300 includes a pair of cutout regions 386 defined substantially entirely within each of liner side panels 328 and 334. Each cutout is rectangular and sized slightly larger than access regions 150 such that cutout regions 386 of liner 300 substantially align with access regions 150 of blank 10 when container 200 is formed. Together, cutout regions 386 and access regions 150 provide a space for a user to insert his or her fingers to grasp container 200. In alternative embodiments, liner 300 includes cutout regions 386 in any suitable number and configuration that enables liner 300 and/or container 200 to function as described herein.

In the example embodiment, liner 300 is fabricated from a corrugated cardboard material and includes a plurality of corrugations or flutes (not shown) therein, oriented parallel to a corrugation direction indicated at 390. As described further herein, corrugation direction 390 facilities improved strength blank 10 when erected into a shell.

As will be described below in more detail with reference to FIGS. 4-7, liner 300 is intended to fit inside shell 198 to form container 200 as shown in FIGS. 4-7 by folding panels 328, 332, and 334 (shown in FIG. 2). Of course, liners having different shapes, sizes, and configurations different from liner 300 described and illustrated herein may be used to form container 200 as shown in FIGS. 4-7 without departing from the scope of the present invention. In other words, the processes described herein can be used to form a variety of different shaped and sized containers, and is not limited to liner 300 shown in FIG. 2 and/or container 200 shown in FIGS. 4-7.

Figure 3:
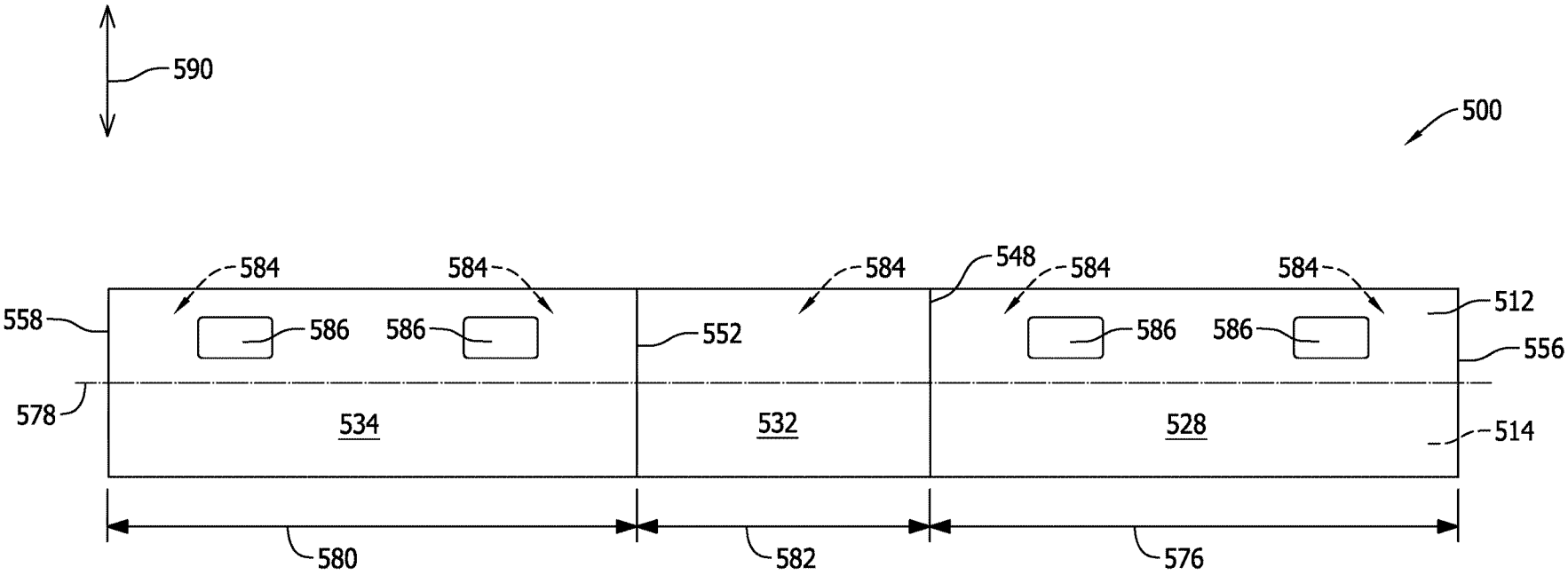
FIG. 3 illustrates a top plan view of another example embodiment of a liner used with the blank shown in FIG. 1 for constructing another reinforced, convertible shipping container.

FIG. 3 illustrates a top plan view of another example embodiment of a liner 500 used with blank 10 for constructing container 200. Liner 500 (or liner blank 500, or second blank 500) has an interior surface 512 and an exterior surface 514. Liner 500 includes a series of aligned wall panels and end panels connected together by a plurality of preformed, generally parallel, fold lines. Specifically, the walls panels include a first liner side panel 528, a liner end panel 532 (or a first liner end panel), and a second liner side panel 534 connected in series along a plurality of fold lines 548 and 552. First liner side panel 528 extends from a first free edge 556 to fold line 548, liner end panel 532 extends from first liner side panel 528 along fold line 548, and second liner side panel 534 extends from liner end panel 532 along fold line 552 to a second free edge 558. In alternative embodiments, a second liner end panel (not shown) is provided that extends from second liner side panel 534 at free edge 558 and is substantially congruent to first liner end panel 532.

First liner side panel 528 has a width 576 taken along a central horizontal axis 578 of liner 500 that is substantially equal to width 580 of second liner side panel 534, also taken along central horizontal axis 578 of liner 500. Widths 576 and 580 are slightly less than widths 110 and 112 of blank 10 to accommodate liner 500 inside shell 198 when blank 10 is constructed into shell 198. Liner end panel 532 has a width 582 taken along central horizontal axis 578. Width 582 is slightly less than width 80 or width 76 of blank 10 to accommodate liner 500 inside shell 198.

In the example embodiment, liner 500 includes a plurality of adhesive regions 584 for an adhesive to be applied to the exterior surface 514 of liner 500 to couple liner 500 to shell 198. In alternative embodiments, liner 500 is coupled to shell 198 using, for example, fasteners, another suitable bonding material, and/or any other suitable method for attaching a liner to a shell.

In the example embodiment, liner 500 includes a pair of cutout regions 586 defined substantially entirely within each of liner side panels 528 and 534. Each cutout is rectangular and sized slightly larger than access regions 150 such that cutout regions 586 of liner 500 substantially align with access regions 150 of blank 10 when container 200 is formed. Together, cutout regions 586 and access regions 150 provide a space for a user to insert his or her fingers to grasp container 200. In alternative embodiments, liner 500 includes cutout regions 586 in any suitable number and configuration that enables liner 500 and/or container 200 to function as described herein.

In the example embodiment, liner 500 is fabricated from a corrugated cardboard material and includes a plurality of corrugations or flutes (not shown) therein, oriented parallel to a corrugation direction indicated at 590. As described further herein, corrugation direction 190 facilities improved strength blank 10 when erected into a shell.

As will be described below in more detail with reference to FIGS. 4-7, liner 500 is intended to fit inside shell 198 to form container 200 as shown in FIGS. 4-7 an adhering liner 500 to shell 198 (not shown). Of course, liners having different shapes, sizes, and configurations different from liner 500 described and illustrated herein may be used to form container 200 as shown in FIGS. 4-7 without departing from the scope of the present invention. In other words, the processes described herein can be used to form a variety of different shaped and sized containers, and is not limited to liner 500 shown in FIG. 2 and/or container 200 shown in FIGS. 4-7.

Figure 4:
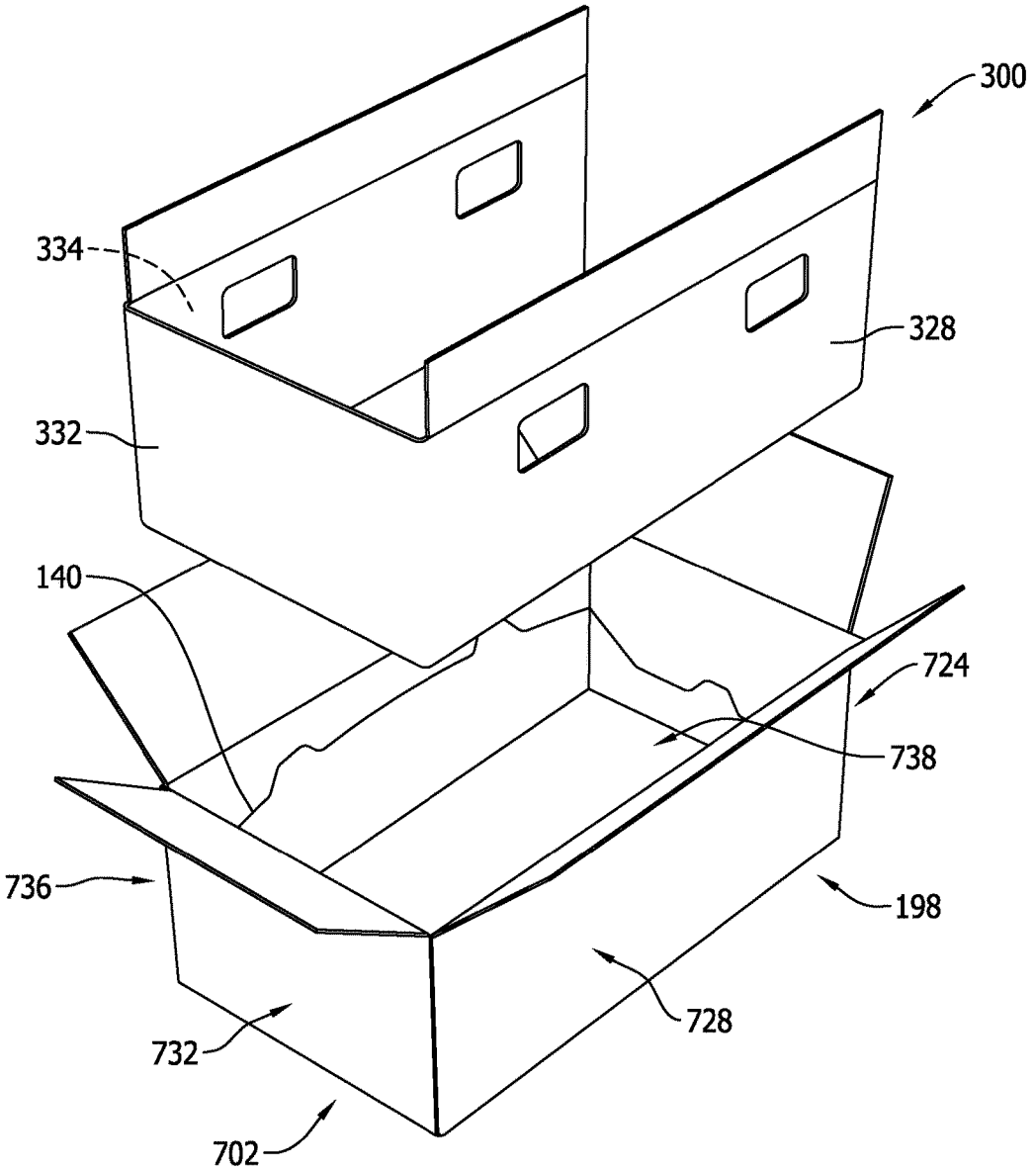
FIG. 4 illustrates an exploded view of the reinforced, convertible shipping container in a filling configuration, including a shell formed from the blank of sheet material and a liner.

FIG. 4 illustrates an exploded view of an example container 200 in a filling configuration 606, container 200 including shell 198, which is formed from blank 10 (shown in FIG. 1), and liner 300, which is configured to be placed inside shell 198. FIG. 5 illustrates a perspective view of example container 200, which is erected into a partially closed position 608 with liner integrated with shell 198. FIG. 6 illustrates example container 200 in a completely closed, shipping configuration 610. FIG. 7 illustrates example container 200 with top portion 202 of container 200 removed, converting container 200 into a display configuration 612. For example, container 200 may be erected into filling configuration 606 and filled with product at a packing facility, partially closed to integrate liner 300 with shell 198 in partially closed position 608, converted into shipping configuration 610 by closing the top, shipped to a retail facility, and converted into display configuration 612 and placed on a shelf at the retail facility, where consumers can view and extract product for purchase directly from container 200.

Turning more specifically to FIG. 4, container 200 includes shell 198 and, in the example shown, liner 300. In alternative embodiments, container 200 includes shell 198 and liner 500, or any other shell and liner that enables container 200 to function as described herein. Shell 198 includes a bottom wall 702, a first end wall 724, a first side wall 728, a second end wall 732 opposing first end wall 724, and a second side wall 736 opposing first side wall 728. In the example embodiment, each of the end walls 724 and 732 is generally perpendicular to each of the side walls 728 and 736, and each of the end walls 724 and 732 and side walls 728 and 736 is generally perpendicular to bottom wall 702, such that shell 198 has a generally rectangular shape. In alternative embodiments, end walls 724 and 732, side walls 728 and 736, and bottom wall 702 have any relative orientation that enables shell 198 to function as described herein. In further alternative embodiments, shell 198 and/or container 200 has a generally square shape, or may have more than four side panels and/or side walls. End walls 724 and 732, side walls 728 and 736, and bottom wall 702 cooperate to define cavity 738 of shell 198.

In the example embodiment, bottom wall 702 includes first bottom end panel 62, first bottom side panel 96, second bottom end panel 68, and second bottom side panel 102 folded and configured to substantially close the bottom end of shell 198. First end wall 724 includes first end panel 24 and tab 38, first side wall 728 includes first side panel 28, second end wall 732 includes second end panel 32, and second side wall 736 includes second side panel 34.

Although shell 198 may be secured together using any suitable fastener at any suitable location on shell 198 without departing from the scope of the present disclosure, in certain embodiments, adhesive (not shown) is applied to an inner surface and/or an outer surface of first end panel 24 and/or tab 38 to form first end wall 724. For example, in the embodiment illustrated in FIG. 1, blank 10 includes two areas on which adhesive is applied before or during the process in which blank 10 is formed into container 200. In the example embodiment, adhesive is disposed on exterior surface 14 of a middle portion of tab 38, leaving a top portion and a bottom portion of tab 38 free of adhesive. In addition, adhesive may be disposed on exterior surface 14 of second side panel 34.

In certain embodiments, adhesive may also be applied to exterior surfaces of bottom side panels 96 and/or 102 and/or interior surfaces of bottom end panels 62 and/or 68 to secure bottom side panels 62 and/or 68 to bottom end panels 96 and/or 102. Similarly, adhesive may also be applied to exterior surfaces of top side panels 94 and/or 104 and/or interior surfaces of top end panels 60 and/or 70 to secure top end panels 60 and/or 70 to top side panels 94 and/or 104. As a result of the above example embodiment of shell 198, each of the manufacturing joints between tab 38 and first end panel 24, bottom wall 702, and top wall 740 (shown in FIG. 6) may be securely closed so that various products may be securely contained within container 200.

In the example embodiment, liner 300 is positioned in shell 198 to form container 200 such that first liner side panel 328 aligns with first side panel 28 of blank 10 to form first side wall 728, liner end panel 332 aligns with second end panel 32 of blank 10 to form second end wall 732, and second liner side panel 334 aligns with second side panel 34 of blank 10 to form second side wall 736. In alternative embodiments, liner 300 is positioned in shell 198 in any configuration that enables container 200 to function as described herein. Once liner 300 is positioned in shell 198, container 200 is in a filling configuration 606 for placing products in cavity 738.

Turning more specifically to FIG. 5, to erect container 200 into a partially closed position 608, first top end panel 60 and second top end panel 70 are rotated about fold lines 64 and 74, respectively, into a substantially perpendicular relationship with end walls 724 and 732. First top liner panel 360 and second top liner panel 364 are rotated about fold lines 362 and 366, respectively, into a substantially perpendicular relationship with side walls 728 and 736.

FIG. 6 illustrated container 200 in a completely closed, shipping configuration 610. A top wall 740 includes first top end panel 60, first top side panel 94, second top end panel 70, and second top side panel 104 rotated about fold lines 64, 98, 74, and 108, respectively, configured to substantially close the top end of shell 198.

Due to the corrugation direction 190 of flutes within blank 10, end panels 24 and 32 and side panels 28 and 34 have vertically oriented flutes when container 200 is formed. Moreover, as line of weakness 140 is formed on blank 10, if container 200 only included end walls 24 and 32 and side walls 28 and 34, container 200 may be structurally weak. Therefore, providing liner 300 with shell 198 increases a stacking strength in comparison to containers without liner 300.

Turning more specifically to FIG. 7, example container 200 is shown with top portion 202 of container 200 removed from display portion 204, converting container 200 into a display configuration 612. Top portion 202 includes the area of blank 10 above line of weakness 140 and substantially the entire liner 300. Bottom portion 204 includes the remaining area of blank 10 below line of weakness 140. In the example embodiment, line of weakness 124 is substantially congruent to line of weakness 132, such that, when the container is formed, bottom portions 204 of panels 24 and 32 are substantially congruent. In other embodiments, line of weakness 124 extending across panel 24 is not congruent to line of weakness 132 extending across panel 32 such that the size of bottom portions 204 of panels 24 and 32 are different. In the example embodiment, line of weakness 128 is substantially congruent to line of weakness 134 such that, when the container is formed, bottom portions 204 of panels 28 and 34 are substantially congruent. In other embodiments, line of weakness 128 extending across panel 28 is not congruent to line of weakness 134 extending across panel 34 such that the size of bottom portions 204 of panels 28 and 34 are different.

Reinforcing liner 300 or 500 is coupled to top portion 202 of outer shell 198 such that, when container 200 is converted from shipping configuration 610 to display configuration 612 by separating top portion 202 from tray portion 204 along line of weakness 140, reinforcing liner 300 or 500 is removed along with top portion 202 of outer shell 198. In one embodiment, liner 300 is coupled with top portion 202, and more specifically, top side panels 94, 104 of blank 10 when container 200 is formed. In another embodiment, liner 500 is coupled with top portion 202, and more specifically, adhered to portion of at least one of panels 24, 28, 32, and 34 of blank 10 above line of weakness 140. Therefore, when top portion 202 is separated from tray portion 204, liner 300, 500 is not inadvertently left in tray portion 204. Tray portion 204 is configured to provide a substantially unobstructed view of a product(s) contained in tray portion 204 to a consumer when container 200 is in display configuration 612 when liner 300, 500 is substantially removed with top portion 202. Container 200 adds the benefit of a stacking strength of liner 300, 500 without the disadvantages to inadvertently leaving liner 300, 500 in tray portion 204 when container 200 is in display configuration 612.

The above-described embodiments provide a container that may be formed from a blank of sheet material and a liner. The embodiments provide a container formed from the blank that includes a liner inside the container to provide enhanced stacking strength. In addition, the example embodiments described herein enable formation of a container that can more easily convert from a shipping configuration to a display configuration.

Exemplary embodiments of a container formed to contain a product therein and blanks and methods for making the same are described above in detail. The blanks, the liners, the container, and the methods are not limited to the specific embodiments described herein, but rather, components of the blanks and/or the container and steps of the method may be utilized independently and separately from other components and steps of the method described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A reinforced shipping container convertible from a shipping configuration to a display configuration, the container formed from a pair of blanks, the container comprising:

an outer shell formed from a first blank, the outer shell comprising:

a plurality of side faces comprising first and second sets of opposing side walls, the plurality of side faces including a line of weakness extending across said side faces, the line of weakness defining a top portion and a tray portion of the outer shell, the line of weakness enabling separation of the top portion from the tray portion of the outer shell; and a reinforcing liner formed from a second blank positioned within the outer shell, the liner comprising:

a plurality of side panels comprising at least a first, a second and a third side liner panel, wherein the first and third side liner panels are positioned adjacent to and in a face-to-face relationship with one of the side walls of one of the sets of side walls of the outer shell, and wherein the second side liner panel is positioned adjacent to and in a face-to-face relationship with one of the side walls of one of the other sets of side walls of the outer shell;

wherein the reinforcing liner is coupled to the top portion of the outer shell such that, when the container is converted from the shipping configuration to the display configuration by separating the top portion from the tray portion along the line of weakness, the reinforcing liner is removed along with the top portion of the outer shelly wherein the liner further comprises:

a first liner top panel extending from a top edge of the first side liner panel; and a second liner top panel extending from a top edge of the third side liner panel, wherein the first top panel and the second top panel are configured to couple to the top portion of the outer shell;

wherein the outer shell further includes a set of first top panels coupled to the first set of opposing side walls and a set of second top panels coupled to the second set of opposing side walls, wherein the first liner top panel and the second liner top panel are sandwiched between the set of first top panels and the set of second top panels.

2. The container in accordance with claim 1, wherein at least a portion of the reinforcing liner is adhesively coupled to a top portion of at least one of the plurality of side faces of the outer shell.

3. The container in accordance with claim 1, wherein the plurality of side faces of the outer shell include a plurality of access regions thereon, the plurality of side panels of the reinforcing liner include a plurality of cutout regions, and the cutout regions substantially align with the plurality of access regions.

4. The container in accordance with claim 1, wherein the line of weakness extends accurately across at least one of the plurality of said side faces.

5. The container in accordance with claim 1, wherein the line of weakness extends across a first side face of the plurality of said side faces such that tray portion of the first side face is not congruent to a side face opposite of the first side face.

6. A pair of blanks for constructing a container, said pair of blanks comprising:

an outer shell blank formed from a first blank, the outer shell blank comprising:

a plurality of side panels including:

a first end panel;

a first side panel extending from a side edge of the first end panel;

a second end panel extending from a side edge of the first side panel;

a second side panel extending from a side edge of the second end panel; and a line of weakness extending across said plurality of side panels, the line of weakness defining a top portion and a tray portion of the outer shell blank; and a plurality of top panels extending from a top edge of each of the first end panel, the first side panel, the second end panel, and the second side panel; and a plurality of bottom panels extending from a bottom edge of each of the first end panel, the first side panel, the second end panel, and the second side panel; and a reinforcing liner blank formed from a second blank, the reinforcing liner comprising:

a plurality of liner side panels comprising at least a first, a second, and a third side liner panel, wherein the second side liner panel extends from a side edge of the first side liner panel, and the third side liner panel extends from a side edge of the second side liner panel;

a first top liner panel extending from a top edge of the first side liner panel; and a second top liner panel extending from a top edge of the third side liner panel; and wherein the first liner top panel and the second liner top panel are configured to be sandwiched between a first set of the plurality of top panels and a second set of the plurality of top panels when the constrainer is constructed from the pair of blanks.

7. The pair of blanks in accordance with claim 6, wherein the shell blank further comprises a plurality of access regions on at least one of the first end panel, the first side panel, the second end panel, and the second side panel, the reinforcing liner blank further comprises a plurality of cutout regions on at least one of the plurality of liner side panels of the reinforcing liner blank, and the plurality of access regions substantially align with the plurality of cutout regions when the container is formed.

8. The pair of blanks in accordance with claim 6, wherein the line of weakness extends arcuately across at least one of the plurality of said side panels.

9. The pair of blanks in accordance with claim 6, wherein the line of weakness extending across the first end panel is substantially congruent to the line of weakness extending across the second end panel, and the line of weakness extending across the first side panel is substantially congruent to the line of weakness extending cross the second side panel.

10. The pair of blanks in accordance with claim 6, wherein the shell blank further comprises a tab extending from a side edge of the second side panel, the tab configured to attach the second side panel to the first end panel when the container is formed.

11. The pair of blanks in accordance with claim 6, wherein the liner blank further comprises a fourth side liner panel extending from a side edge of the third side liner panel.

* * * * *